US007549473B2

(12) United States Patent
Underwood

(10) Patent No.: US 7,549,473 B2
(45) Date of Patent: Jun. 23, 2009

(54) LIQUID REMOVAL SYSTEM AND METHOD

(76) Inventor: Jerry Underwood, 340 Jake Field Rd., Clayton, GA (US) 30525

( * ) Notice: Subject to any disclaimer, the term of this patent is extended or adjusted under 35 U.S.C. 154(b) by 0 days.

(21) Appl. No.: 11/690,573

(22) Filed: Mar. 23, 2007

(65) Prior Publication Data

US 2007/0221381 A1 Sep. 27, 2007

Related U.S. Application Data

(60) Provisional application No. 60/785,153, filed on Mar. 23, 2006.

(51) Int. Cl.
*E21B 49/08* (2006.01)

(52) U.S. Cl. ..... 166/264; 166/167

(58) Field of Classification Search ..... 166/264, 166/162, 344, 81.1, 167, 168; 175/59, 20; 73/152.23, 152.54; 137/588, 596; 220/4.06, 220/4.21

See application file for complete search history.

(56) References Cited

U.S. PATENT DOCUMENTS

| | | | | | |
|---|---|---|---|---|---|
| 680,163 | A * | 8/1901 | Mooring | 166/167 |
| 1,513,443 | A * | 10/1924 | Boynton | 166/167 |
| 1,866,828 | A * | 7/1932 | Webber | 166/111 |
| 1,998,075 | A * | 4/1935 | Church | 175/235 |
| 2,176,240 | A * | 10/1939 | Bandy | 166/164 |
| 2,214,551 | A * | 9/1940 | Edwards | 175/59 |
| 2,331,631 | A * | 10/1943 | Rogers et al. | 166/109 |
| 3,055,764 | A * | 9/1962 | Pryor et al. | 166/109 |
| 3,207,223 | A * | 9/1965 | Helmut | 166/163 |
| 4,086,035 | A * | 4/1978 | Klaeger et al. | 417/410.1 |
| 4,271,704 | A * | 6/1981 | Peters | 73/864.63 |
| 4,583,916 | A * | 4/1986 | Senghaas et al. | 417/36 |
| 4,669,554 | A * | 6/1987 | Cordry | 175/59 |
| 5,058,674 | A * | 10/1991 | Schultz et al. | 166/264 |
| 5,228,345 | A * | 7/1993 | Vales | 73/864.31 |
| 5,979,569 | A * | 11/1999 | Heller | 175/20 |
| 6,609,569 | B2 * | 8/2003 | Howlett et al. | 166/264 |

* cited by examiner

*Primary Examiner*—David J Bagnell
*Assistant Examiner*—Cathleen R Hutchins
(74) *Attorney, Agent, or Firm*—Hartman & Hartman, P.C.; Gary M. Hartman; Domenica N. S. Hartman

(57) ABSTRACT

A method and system capable of economically removing a liquid from a liquid reservoir, such as oil from an oil reservoir, by withdrawing limited quantities of the liquid in discrete steps. The system includes a dipping unit sized to be received in a passage to the reservoir, such as a casing of an oil well, and a unit for lowering and raising the dipping unit within the passage. The dipping unit is configured and oriented to have an upper end portion and a lower end portion when within the passage. The dipping unit includes a chamber, a feature for enabling a liquid to enter the chamber when at least its lower end portion is submerged in the liquid within the reservoir, and a feature for releasing the liquid from the chamber. In use, the dipping unit is lowered within passage to a liquid reservoir to enable liquid to flow into the chamber of the dipping unit when at least a lower end portion of the dipping unit is submerged in the liquid within the reservoir, and then raising the dipping unit within the passage so that the liquid is released from the chamber.

22 Claims, 2 Drawing Sheets

LIQUID REMOVAL SYSTEM AND METHOD

CROSS REFERENCE TO RELATED APPLICATIONS

This application claims the benefit of U.S. Provisional Application No. 60/785,153 filed Mar. 23, 2006, the contents of which are incorporated herein by reference.

BACKGROUND OF THE INVENTION

The present invention generally relates to equipment and methods for removing liquids from liquid reservoirs, for example, oil well recovery equipment and methods capable of economically removing oil from an oil field.

An oil well is typically constructed to have a tubing within one or more casings that structurally support the wellbore and seal the wellbore (other than the tubing) at the surface, typically so that the pressure of the oil within the oil field is sufficient to force oil through the tubing to the surface. As an oil field is depleted, this pressure can drop to a sufficiently low level to necessitate the use of artificial lift methods and equipment, examples of which include downhole pumps, gas lifts, and surface pump-jacks. Such measures have been referred to as "secondary recovery" methods. However, because of the costs of typical lift equipment, secondary recovery methods are pursued only if the oil field is believed to make the additional cost and effort economically viable. Wells are abandoned once production drops when even secondary recovery equipment is no longer economically practical. Even so, oil remains within the oil field and would be removed if suitable equipment and methods were available.

BRIEF SUMMARY OF THE INVENTION

The present invention provides a method and system capable of economically removing a liquid from a liquid reservoir, such as oil from an oil well, by withdrawing limited quantities of the liquid in discrete steps.

The system includes a dipping unit sized to be received in a passage to a liquid reservoir, such as the casing of an oil well, and a unit for lowering and raising the dipping unit within the passage. The dipping unit is configured and oriented to have an upper end portion and a lower end portion when within the passage. The dipping unit includes a chamber, a feature for enabling a liquid to enter the chamber when at least its lower end portion is submerged in the liquid within the reservoir, and a feature for releasing the liquid from the chamber.

The method includes lowering a dipping unit within a passage to a liquid reservoir, such as a casing of an oil well, to enable a liquid to flow into a chamber of the dipping unit when at least a lower end portion of the dipping unit is submerged in the liquid within the reservoir, and then raising the dipping unit within the passage so that the liquid is released from the chamber.

In view of the above, the invention can be understood to be very simple and economical for removing liquids from a liquid reservoir, a particularly notable example of which is the removal of oil from an oil well. In the preferred invention, the invention is capable of removing oil from a well more economically than existing secondary recovery systems to the extent that an oil well can remain productive that might otherwise be abandoned as being no longer economically practical if only conventional recovery equipment were available.

Other objects and advantages of this invention will be better appreciated from the following detailed description.

DETAILED DESCRIPTION OF THE INVENTION

Figure 1:
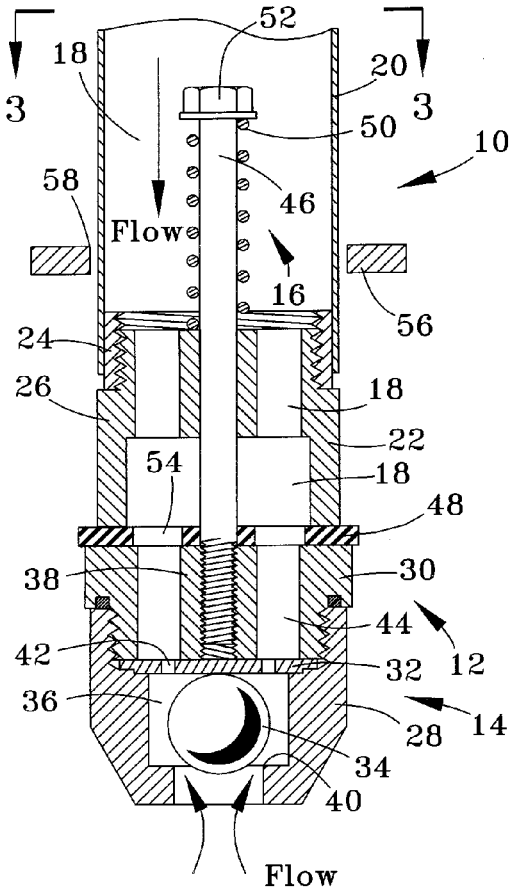
FIG. 1 represents a cross-sectional view of a dipping unit in accordance with a preferred embodiment of this invention, during which a chamber within the dipping unit is being filled with a liquid, such as oil from an oil well.
Figure 2:
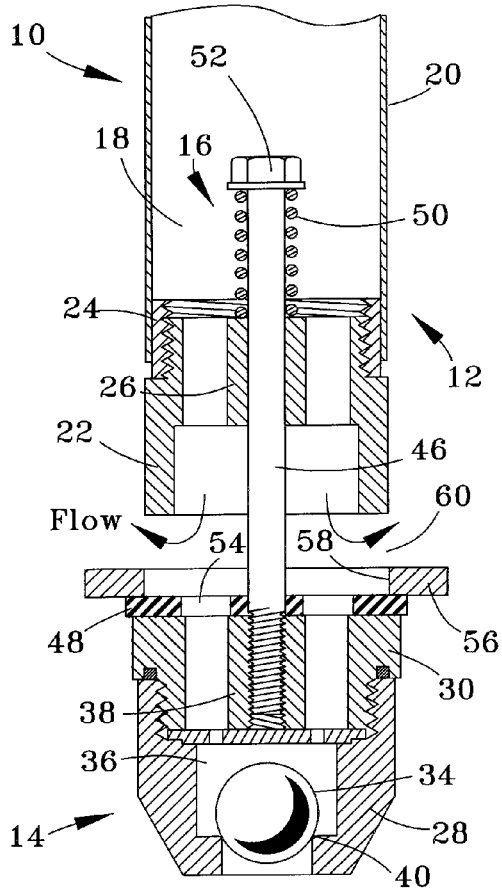
FIG. 2 represents a cross-sectional view of the dipping unit of FIG. 1 during a dump cycle.
Figure 3:
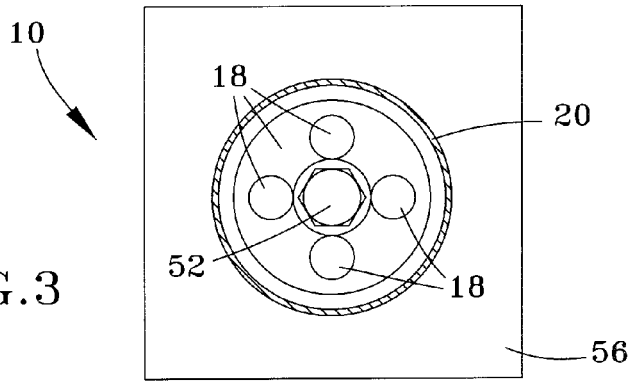
FIG. 3 is a top view of the dipping unit of FIGS. 1 and 2.

FIGS. 1 through 3 depict a dipping unit 10 for use in removing a liquid from a liquid reservoir. A particularly notable application for the unit 10 is an oil recovery system 100 shown in FIG. 4. Though the invention will be described below in reference to an oil well recover system and method, the invention is not so limited. For example, the dipping unit 10 is also well suited for removing water from a water well or other water source or reservoir, such as for the purpose of obtaining water samples for testing, etc.

From FIGS. 1 and 2, it can be seen that the dipping unit 10 generally has upper and lower end portions 12 and 14 held together with a biasing assembly 16. A fill chamber 18 is defined in the upper end portion 12 of the unit 10 by a tube 20, a dump adapter 22, and a fitting 24 that secures the dump adapter 22 to the tube 20. While the fitting 24 is represented as being attached (e.g., welded) to the tube 20 and threaded into the adapter 22, other assembly methods are also within the scope of the invention, including fasteners, an all-welded construction, etc. In addition, it is foreseeable that a unitary construction could be adopted for the upper end portion 12.

The lower end portion 14 of the unit 10 is represented as including a valve body 28 threaded onto a valve head 30, a plate 32 held against a shoulder of the valve body 28 by the valve head 30, and a ball 34 within a chamber 36 of the valve body 28. The ball 34 is free to move within the valve body chamber 36 between a valve seat 40 at the lower end of the chamber 36 and the plate 32 defining the upper end of the chamber 36. The material, size, and density of the ball 34 are preferably selected so that the ball 34 is buoyed or otherwise forced off the seat 40 by the flow of oil (or other liquid intended to be extracted by the dipping unit 10) under the pressure exerted by oil within an oil reservoir (field, accumulation, pool, etc.), such as the reservoir 64 represented in FIG. 4. One or more passages 42 are present in the plate 32 to fluidically connect the valve body chamber 36 to an annular-shaped chamber 44 within the valve head 30, which as discussed below is fluidically connected to the fill chamber 18 within the upper end portion 12 of the unit 10. The annular shape of the chamber 44 is the result of a cylindrical boss 38 attached to or otherwise part of the valve head 30 and/or plate 32. While a ball valve assembly (ball 34 and valve body 28) is shown, from the following discussion it will become evident that other valve assemblies (both mechanically and electrically operated) capable of permitting oil flow into the lower end portion 14 of the dipping unit 10 are also within the scope of the invention.

The biasing assembly 16 is represented as including a bolt 46 that passes through a boss 26 within and secured to the dump adapted 22, passes through a gasket 48 between the upper and lower end portions 12 and 14 of the unit 10, and is threaded into the boss 38 of the valve head 30. A compression spring 50 is compressed between the head 52 of the bolt 46 and the boss 26 of the dump adapter 22, biasing the valve head 30 (and therefore the entire lower end portion 14) toward the upper end portion 12 and compressing the gasket 48 therebetween. One or more passages 54 are defined in the gasket 48 so that the valve body chamber 36 is fluidically connected to the fill chamber 18 within the upper end portion 12 of the unit 10 through the passages 42 in the plate 32, the chamber 44 within the valve head 30, and the passages 54 in the gasket 48. The compression spring 50 provides an in expensive and uncomplicated biasing action well suited for use in the dipping unit 10 of this invention, though it should be understood that other biasing mechanisms are also within the scope of the invention, including other types of springs, elastic materials, pneumatically, mechanically, and electrically operated cylinders, etc.

The dipping unit 10 is further represented as including a plate-like flange 56 with an opening 58 through which the upper end portion 12 of the unit 10 is received. As evident from FIG. 4, the flange 56 is intended to be mounted at or near the upper end of a substantially (though not necessarily) vertical well casing 62 in which the dipping unit 10 operates, and therefore would normally be located a considerable distance from the lower end portion 14 of the dipping unit 10 during a fill cycle. However, for convenience FIG. 1 depicts the flange 56 as immediately above the lower end portion 14 during a fill cycle.

Figure 4:
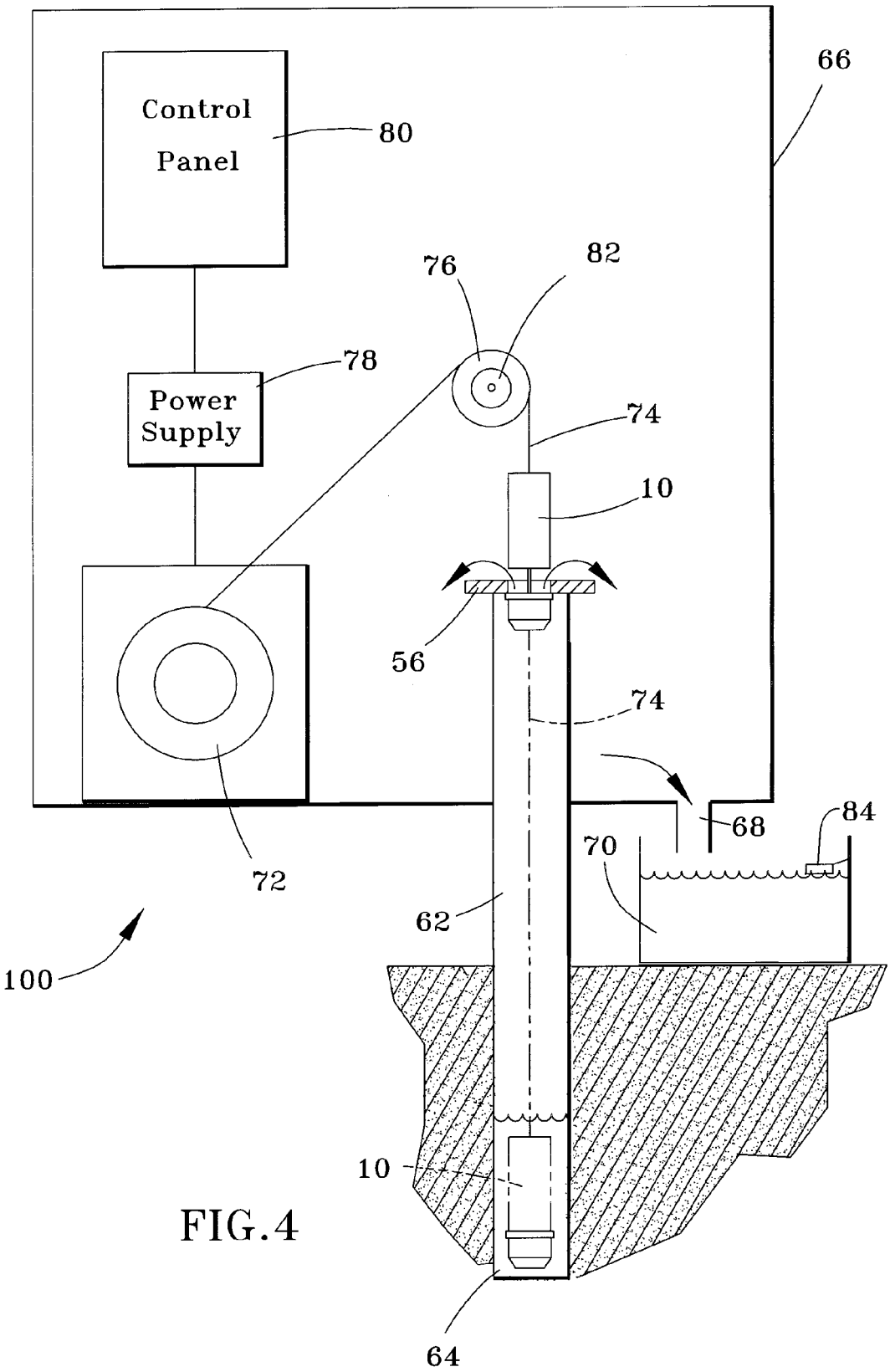
FIG. 4 schematically represents an oil recovery system that includes the dipping unit of FIGS. 1 through 3 in accordance with this invention.

As evident from FIG. 4, the width of the dipping unit 10 is sufficiently less than that of the casing 62 to allow the unit 10 to move freely between the flange 56 and the reservoir 64. From FIG. 2, it can be seen that the lower end portion 14 and gasket 48 of the unit 10 have slightly larger diameters than the upper end portion 12 of the unit 10 and the opening 58 in the flange 56, so that the unit 10 is able to freely travel upward through the opening 58 until the gasket 48 and lower end portion 14 encounter the flange 56, at which point the lower end portion 14 can travel no farther and the gasket 48 seals against the lower surface of the flange 56 surrounding the opening 58. Because of the biasing assembly 16, the upper end portion 12 of the unit 10 is able to continue traveling upward a limited distance (e.g., until the spring 50 is completely compressed). As evident from FIG. 2, the ability of the upper end portion 12 to continue traveling upward relative to the lower end portion 14 results in separation 60 of the end portions 12 and 14 at the lower extremity of the chamber 18.

With the dipping unit 10 as described above, the unit 10 is effectively configured to bail oil from an oil well by filling the fill chamber 18 through the valve body 28 when the lower end portion 14 is sufficiently submerged in oil to cause the ball 34 to unseat from its valve seat 40, as represented in FIGS. 1 and 4. Oil that enters the valve body chamber 36 rises up through the passages 42 within the plate 32 and through the chamber 44 within the lower end portion 14 of the unit 10, and then enters the fill chamber 18 through the passages 54 within the gasket 48. As depicted in FIG. 4, depending on the length of the tube 20 it may also be possible that oil enters the fill chamber 18 from the upper extremity of the upper end portion 12, which is preferably open as indicated in FIG. 3. Once oil flow into the dipping unit 10 ceases as a result of hydraulic pressure equalization, the ball 34 reseats itself against its valve seat 40 and the dipping unit 10 is raised through the well casing 62 until the lower end portion 14 encounters the flange 56 at the top of the casing 62, causing the oil within the fill chamber 18 to be dumped through the separation 60 created between the end portions 12 and 14 of the dipping unit 10. The ball valve assembly 28/34 prevents or otherwise minimizes the loss of oil from the fill chamber 18 as the unit 10 is raised within the casing 62, and the gasket 48 and ball valve assembly 28/34 cooperate to prevent the oil released from the fill chamber 18 from flowing back into the well casing 62.

FIG. 4 schematically represents the oil released from the fill chamber 18 as being dumped into an enclosure 66 that includes a drain pipe 68 through which the oil flows before being collected in a holding tank 70. The tank 70 is represented as equipped with a sensor 84 to detect the presence of water in the oil, for example, a float that is buoyant in oil but not water, so that appropriate actions can be taken to avoid or minimize water contamination, including stoppage of the dipping unit 10 and initiating an inactive period in the recovery process during which oil from the surrounding substrata is allowed to refill the well before resuming oil extraction. Various alternatives are known to be capable of performing the same or equivalent function, such as a sensor in the enclosure 66, drain pipe 68, or tank 70 that detects the presence of water by, for example, sensing electrical conductivity. The water sensor 84 can also be used to initiate water separation from the holding tank 70, such as with an oil/water separator, or actions to remove water from the well. The enclosure 66 further contains a winch 72, a cable 74 (for example one-eight inch (about 3 mm) stainless steel), and a pulley 76 configured to lower and raise the dipping unit 10, an electrical power supply 78 for powering a motor (e.g., a 1 HP electronically-controlled DC servomotor) for the winch 72, and a control panel 80 for housing a control system for operating the winch 72. The control system is preferably equipped to allow for manual, programmed, and automatic operation of the dipping unit 10. For this purpose, the pulley 76 is preferably equipped with an encoder 82 that operates with the cable 74 to monitor the travel of the dipping unit 10. The encoder 82 is also preferably able to detect when vertical movement of the dipping unit 10 ceases, as when the unit 10 encounters a body of oil in the reservoir 64 at the lower end of the casing 62 and when the lower end portion 14 of the unit 10 encounters the flange 56 at the upper end of the well casing 62. The encoder 82 or any suitable switch can be used during operation of the control system in a calibration mode, during which a zero depth for the dipping unit 10 can be associated with the upper limit of travel for the dipping unit 10.

If the control system is a microprocessor-based intelligent control system, feedback from the encoder 82 can be used to train the control system to slow the assent and descent of the dipping unit 10 to allow more gradual stops. Alternatively or in addition to the encoder 82, the current draw of the winch 72 can be monitored or the winch 72, cable 74, or pulley 76 can be equipped with a strain gage to sense when the dipping unit 10 encounters a body of oil at the lower end of the casing 62 and encounters the flange 56 at the lower (fill) and upper (dump) extents, respectively, of the dipping unit 10, as well as to detect any obstruction or other anomaly in the operation of the dipping unit 10. An intelligent control system is also capable of learning the optimum stopping point for effectively recovering oil on an ongoing basis. For example, through feedback from the encoder 82, strain gage, and/or water sensor 84, the control system can learn how deep to lower the dipping unit 10, how many cycles to complete before encountering water, and how long an inactive period is necessary to allow oil from the surrounding substrata to replenish the oil well to a suitable level to permit reinitiating oil extraction.

In its manual operating mode, the control system preferably enables an operator to press buttons to lower and raise the dipping unit 10 all while monitoring a display that continuously shows the depth of the unit 10. Safety limits established by the encoder 82, water sensor 84, strain gage, etc., preferably set outer limits of operation to ensure safety. For the programmed mode, the control system can be preferably programmed for maximum fill depth, dwell time at the fill depth, dwell time at the upper (dump) extent of operation, and number of fill-dump cycles to make in succession before initiating an inactive period during which oil is allowed to replenish the oil well. When operating in the automatic mode, the control system is preferably programmed for maximum fill depth, dwell time at the fill depth, and dwell time at the upper (dump) extent of operation, but then makes use of the feedback from the water sensor 84 to set the number of fill-dump cycles to make in succession before initiating an inactive period. Any of these operating modes can also include a water extraction cycle for the purpose of extracting water from the well with the dipping unit 10. Control systems of the type described above are well within the scope of those skilled in the pertinent art, and therefore will not be described in any further detail.

The capacity of the dipping unit 10 and system 100 can be readily varied according to the particular application. For use as a secondary recovery system in oil fields, the size of the fill chamber 18 within the dipping unit 10 and the operation of the system 100 are believed to be capable of achieving pumping capacities on the order of about five barrels of oil per day, though lesser and greater capacities are also within the scope of this invention.

While the invention has been described in terms of a preferred embodiment, it is apparent that other forms could be adopted by one skilled in the art. For example, the physical configuration of the dipping unit 10, enclosure 66, and their individual components could differ from those shown and discussed, and various materials and processes for manufacturing the dipping unit 10, enclosure 66, and their individual components are known to those skilled in the art and could be used. Therefore, the scope of the invention is to be limited only by the following claims.

The invention claimed is:

1. A system for removing a liquid from a liquid reservoir by withdrawing limited quantities of the liquid in discrete steps, the system comprising:

a dipping unit sized to be received in a passage to the liquid reservoir and oriented to have an upper end portion and a lower end portion when within the passage, the dipping unit comprising a chamber, means for enabling the liquid to enter the chamber when at least the lower end portion is submerged in the liquid within the liquid reservoir, and means for releasing the liquid from the chamber; and means for lowering and raising the dipping unit within the passage;

wherein the releasing means comprises means for separating the upper and lower end portions of the dipping unit to define a separation therebetween through which the liquid is released from the chamber, the separating means being operable to define the separation by stopping upward movement of the lower end portion while not stopping upward movement of the upper end portion while the dipping unit is being raised by the lowering and raising means.

2. The system according to claim 1, wherein the enabling means comprises a ball and valve body within the lower end portion of the dipping unit.

3. The system according to claim 2, wherein the ball and valve body are operable to prevent the liquid from flowing from the chamber when the lower end portion of the dipping unit is not submersed in the liquid.

4. The system according to claim 1, wherein the chamber is located within the upper end portion of the dipping unit.

5. The system according to claim 1, wherein the releasing means comprises a spring-biased connection between the upper and lower end portions of the dipping unit.

6. The system according to claim 5, wherein the chamber is located within the upper end portion of the dipping unit.

7. The system according to claim 6, wherein the spring-biased connection is operable to separate the upper and lower end portions of the dipping unit in proximity to a lower extremity of the chamber.

8. The system according to claim 1, wherein the enabling means comprises at least one opening in the upper end portion of the dipping unit.

9. The system according to claim 1, wherein the enabling means comprises an open end at an upper extremity of the upper end portion of the dipping unit, the open end enabling the liquid to enter the chamber when the upper end portion is submerged in the liquid within the liquid reservoir.

10. The system according to claim 1, wherein the lowering and raising means is operable to lower the dipping unit into the liquid within the liquid reservoir and raise the dipping unit to an upper extremity of the passage.

11. The system according to claim 1, wherein the lowering and raising means comprises means for sensing travel distance of the dipping unit, means for sensing when the dipping unit is submerged in the liquid within the liquid reservoir, and means for sensing when the dipping unit is at an upper extremity of the passage.

12. The system according to claim 1, further comprising means for automatically operating the lowering and raising means.

13. The system according to claim 1, further comprising means for manually operating the lowering and raising means.

14. The system according to claim 1, further comprising an enclosure in which the dipping unit is housed, the enclosure being configured to receive the liquid released by the releasing means from the chamber.

15. A system for removing a liquid from a liquid reservoir by withdrawing limited quantities of the liquid in discrete steps, the system comprising:

a dipping unit sized to be received in a passage to the liquid reservoir and oriented to have an upper end portion and a lower end portion when within the passage, the dipping unit comprising a chamber, means for enabling the liquid to enter the chamber when at least the lower end portion is submerged in the liquid within the liquid reservoir, and means for releasing the liquid from the chamber; and means for lowering and raising the dipping unit within the passage;

wherein the system is installed on an oil well, the passage is a well casing of the oil well, and the liquid reservoir is an oil reservoir from which the dipping unit removes oil; and wherein the releasing means also seals the oil casing with the lower end portion to prevent the oil released from the chamber from re-entering the oil casing.

16. A method for removing a liquid from a liquid reservoir by withdrawing limited quantities of the liquid in discrete steps, the method comprising:

providing a dipping unit sized to be received in a passage to the liquid reservoir and oriented to have an upper end portion and a lower end portion when within the passage;

lowering the dipping unit within the passage to enable the liquid to flow into a chamber within the dipping unit when at least the lower end portion of the dipping unit is submerged in the liquid within the liquid reservoir;

raising the dipping unit within the passage; and causing the upper and lower end portions of the dipping unit to separate and define a separation therebetween through which the liquid is released from the chamber by stopping upward movement of the lower end portion of the dipping unit while not stopping upward movement of the upper end portion of the dipping unit while the dipping unit is being raised.

17. The method according to claim 16, wherein the liquid is prevented from flowing from the chamber when the lower end portion of the dipping unit is not submersed in the liquid.

18. The method according to claim 16, wherein the liquid is released from the chamber as a result of the upper and lower end portions of the dipping unit separating in proximity to a lower extremity of the chamber.

19. The method according to claim 16, wherein at least some of the liquid enters the chamber through at least one opening within the upper end portion of the dipping unit when the upper end portion is at least partially submerged in the liquid within the liquid reservoir.

20. The method according to claim 16, further comprising sensing travel distance of the dipping unit, sensing when the dipping unit is submerged in the liquid within the liquid reservoir, and sensing when the dipping unit is at an upper extremity of the passage.

21. The method according to claim 16, further comprising automatically lowering and raising the dipping unit based on a preset maximum fill depth, a dwell time at the fill depth during which the liquid flows into the chamber, and a dwell time during which the liquid is released from the chamber, and detecting the presence of a second liquid in the liquid released from the chamber.

22. The method according to claim 16, wherein the liquid reservoir is an oil reservoir and the liquid is oil removed from the oil reservoir by the dipping unit.

* * * * *